United States Patent [19]

Worst

[11] 4,284,276

[45] Aug. 18, 1981

[54] GROOVED GOLF BALL

[76] Inventor: Joseph C. Worst, 3606 Nandina Dr., Louisville, Ky. 40222

[21] Appl. No.: 121,030

[22] Filed: Feb. 13, 1980

[51] Int. Cl.[3] ..... A63b 37/14

[52] U.S. Cl. ..... 273/232; 40/327

[58] Field of Search ..... 273/232, 62, 213, 233, 273/183 C

[56] References Cited

U.S. PATENT DOCUMENTS

| | | | |
|---|---|---|---|
| 878,254 | 2/1908 | Taylor | 273/232 |
| 922,773 | 5/1909 | Kempshall | 273/232 |
| 1,681,167 | 8/1928 | Beldam | 273/232 |
| 2,135,210 | 11/1938 | Farrar | 273/232 |
| 3,819,190 | 6/1974 | Nepela et al. | 273/232 |

FOREIGN PATENT DOCUMENTS

| | | | |
|---|---|---|---|
| 20778 | of 1911 | United Kingdom | 273/232 |
| 904785 | 8/1962 | United Kingdom | 273/232 |
| 1459646 | 12/1976 | United Kingdom | 273/232 |

*Primary Examiner*—George J. Marlo

*Attorney, Agent, or Firm*—Richard L. Caslin

[57] ABSTRACT

A golf ball is shown with an outer surface that is substantially covered with a plurality of spaced dimples that give the ball a suitable long and predictable flight pattern for wood or iron shots due to imparting an increased lift to the ball when the ball is given a backspin. Several modifications of the invention are shown. One or more elongated grooves are formed on the outer surface of the ball for interlocking with grooves that are formed in the face of a golf club so as to increase the grip as well as achieve more "hang time" for a given amount of backspin of the ball. Another modification has a cluster of grooves that is spaced about 90° from the manufacturer's brand name indicia that is marked on the ball. The preferred modification has a continuous band of grooves that encircles the ball and increases the amount of backspin the ball will have leaving the tee which will improve the trajectory or "hang time" of the driven ball. Moreover, the use of the grooves improve the aerodynamics of the ball in flight by causing more air turbulence and thereby increasing the lift of the ball.

14 Claims, 11 Drawing Figures

GROOVED GOLF BALL

BACKGROUND OF THE INVENTION

1. Field of the Invention

This invention relates to the configuration of the outer surface or cover of golf balls, and particularly to such designs which relate to the pattern of the dimpled surface area of the ball in combination with elongated grooves which are able to interlock with grooves in a golf club face so as to increase the backspin and improve the aerodynamic characteristics of the ball when making tee shots.

2. Description of the Prior Art

A pioneer patent in the art of golf balls is the Taylor U.S. Pat. No. 878,254 of Feb. 4, 1908 which taught for the first time that the outer surface of a golf ball should be provided with a plurality of spaced dimples which substantially cover the outer surface. The advantage of this dimpled surface is that it gives stability in flight and also increased lift to the ball. In the words of the Taylor patent, "Its principal object is to obtain better results in the flight of the ball in the direction of a sustained hanging flight giving a flat trajectory with a slight rising tendency particularly toward the end of the flight, than have been possible with balls of known types." A smooth surfaced ball that is driven by a given force at a given angle would stay in the air only 2 seconds, while the Taylor dimpled ball would stay in the air 5 seconds for a good wood shot. This is due to the turbulent air action caused by the dimples on the forward moving ball which is back-spinning. The Taylor dimples take advantage of the Bernoulli Effect, which is well known in the science of aerodynamics, to create a vacuum over the top surface of the ball which causes the ball to rise and have a longer "hang" time in flight. The teachings in this Taylor patent are believed to be found in every golf ball on the market at the present time.

The Beldam U.S. Pat. No. 1,681,167 describes the surface configuration of a golf ball where the primary object is to provide a form or character of surface by which a better "grip" of the club with the ball is obtained without slip or relative movement. Also the surface configuration furnishes a better "grip" of the "green", and hence a truer run. The outer surface is filled with rectangular recesses that are surrounded by cross ribs.

The Nepela et al U.S. Pat. No. 3,819,190 describes in FIG. 4 a golf ball having a central, continuous band of depressions positioned between two polar regions, each region having a relatively smooth surface. The depressions are formed by a series of grooves which extend from one smooth polar region to the other smooth polar region. The ridges, which separate adjacent grooves, combine with the grooves to create turbulence thereby to increase the film of air spinning with the ball as did the dimples in the earlier modifications of this Nepela et al patent. It should be appreciated that this modification of FIG. 4 of the Nepela et al patent contains no dimples in addition to the grooves. Moreover, the two ends of each groove do not appear to be reduced as is taught in the present invention.

The Kempshall U.S. Pat. No. 922,773 describes a golf ball which has a surface configuration that possesses considerable anti-slipping properties. There are a series of projecting bands comprising alternating wider and narrower portions, where the wider portions have circular dimples therein, and protuberances within the said dimples.

The Farrar U.S. Pat. No. 2,135,210 describes a golf ball having alternate parallel grooves extending continuously around the ball and having their boundaries defined by true circles. This Farrar ball has no dimples. If this ball were hit from the fairway it would most likely have an unpredictable flight pattern.

OBJECTS OF THE PRESENT INVENTION

The principal object of the present invention is to provide a golf ball with one or more grooves for interlocking with grooves in the face of a golf club so as to increase both the backspin and lift of the ball and hence the distance travelled on a tee shot.

A further object of the present invention is to provide a grooved golf ball of the class described so as to achieve more "hang time" for a given amount of backspin.

SUMMARY OF THE INVENTION

The present invention provides a spherical golf ball having in its outer surface a plurality of spaced dimples which substantially cover the outer surface. In place of certain of the dimples, one or more elongated grooves are formed on the outer surface of the ball for use in interlocking or gripping with the striking face of a golf club. The elongated groove has a transverse width dimension that is substantially the same as the width of a dimple. Also the groove has a generally uniform transverse cross section that is substantially the same as the transverse cross section of a dimple. Moreover, the groove has reduced or rounded ends so as not to accumulate dirt therein.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENTS

Figure 1:
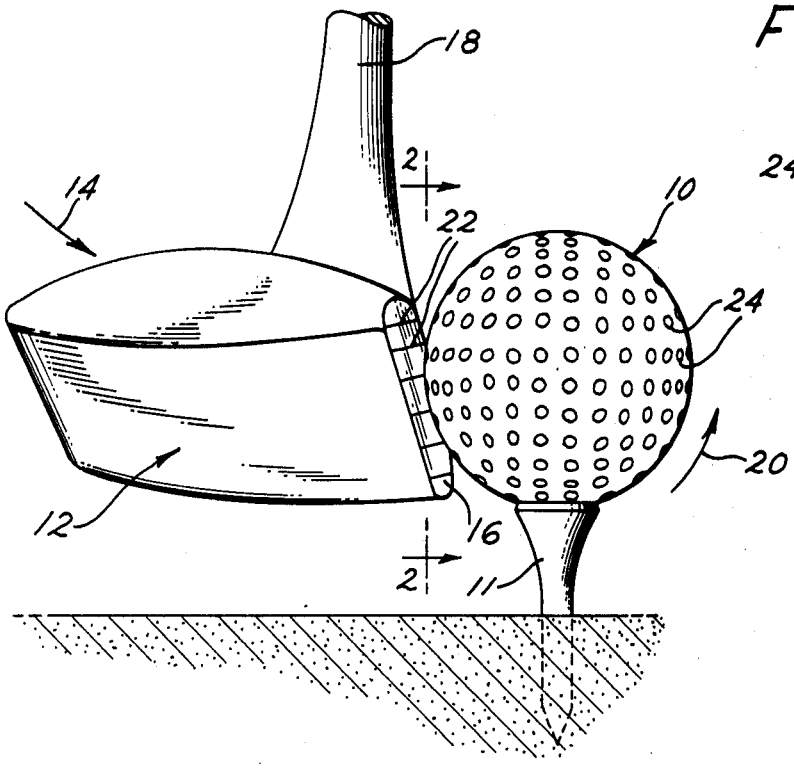
FIG. 1 is an elevational view of a spherical golf ball and a wood club in a teed-up shot showing how to produce a backspin on the ball by striking the ball a descending blow.

Turning now to a consideration of the drawings and, in particular, to the back side elevational view of a spherical golf ball 10, it is shown positioned on a tee 11 and being contacted by a standard wood club 12. The club is of the type that would be used by a right handed golfer, and it moves in a gradually descending arc 14. The face 16 of the head of the club has a slight loft or angle as would be measured by the included angle with the longitudinal axis 18 of the shaft of the club. Thus when the club is maintained generally vertical at the moment of contact with the ball, the point of contact is below the horizontal center line of the ball. The descending direction of movement of the head of the club during the swing creates a backspin to the ball which is shown turning in the counterclockwise direction 20. The face 16 of the club is formed with a plurality of horizontal grooves 22 for increasing the grip on the ball.

A golf ball must have an adequate number of shallow dimples 24 for the ball to have a suitable and predictable flight pattern for wood and iron shots. A standard dimple is circular with a surface diameter of about 0.127 inches, and an average number of dimples on a standard golf ball is about 335 dimples, although there appears to be a trend to reduce the total number of dimples per ball. The area of a dimple is $(\pi/4)d^2=0.0127$ sq. in. The total area of 335 dimples=4.241 sq. in. The total surface area of a standard golf ball is $\pi d^2=8.867$ sq. in. Thus the percent of total surface area having dimples=47.83%.

Other forms of dimples are pentagons or hexagons rather than circular.

Figure 2:
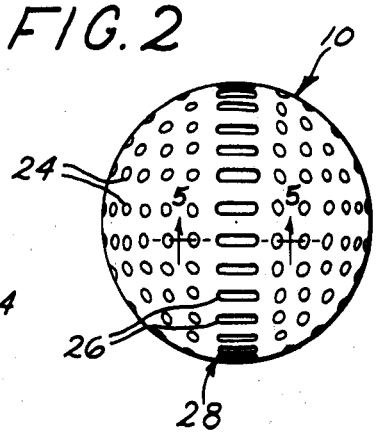
FIG. 2 is another elevational view of the golf ball of FIG. 1, taken on the line 2—2 of FIG. 1, to show that certain of the dimples in the cover of the ball have been replaced by a continuous band of elongated grooves around the circumference of the ball for use in interlocking with grooves in the striking face of the golf club to increase the grip and thus the backspin of the ball. This modification of FIG. 2 has minimum length elongated grooves as substantially equal to the mean center to center distance between adjacent dimples plus one mean diameter of a dimple.

FIG. 2 is an elevational view of the ball 10 taken on the line 2—2 of FIG. 1. This FIG. illustrates a plurality of elongated grooves 26 which form a continuous band 28 around the circumference of the ball 10. The purpose of these grooves 26 is to interlock with the grooves 22 in the face 16 of the club 12. These grooves 26 generally encompass certain of the dimples 24. This FIG. 2 shows a modification of the present invention where the grooves 26 are of minimum length, which is defined as being substantially equal to the mean center to center distance between adjacent dimples plus one mean diameter of a dimple.

Figure 3:
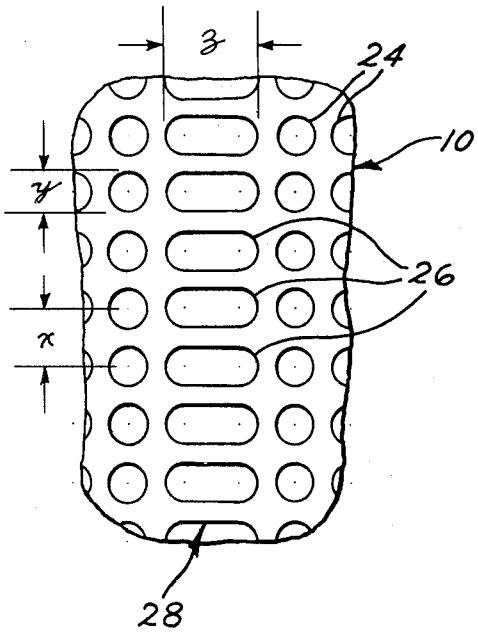
FIG. 3 is a fragmentary layout on an enlarged scale of the cover of the golf ball of FIG. 2.

FIG. 3 is a fragmentary layout on an enlarged scale of the cover of the golf ball of FIG. 2 having minimum length grooves 26; where the mean center to center distance between adjacent dimples 24 is labeled as "x", and the mean diameter of a dimple is labeled as "y", and the minimum groove length is labeled as "z". Hence, $z=x+y$.

Figure 4:
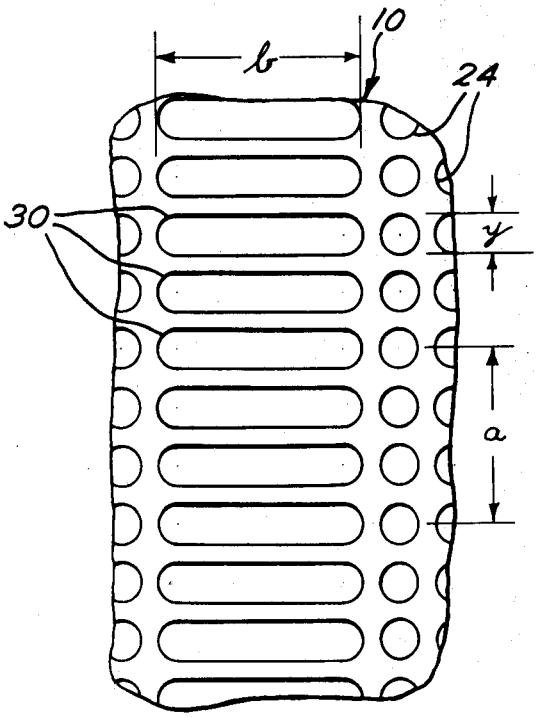
FIG. 4 is a modification of the invention of FIGS. 2 and 3 showing the layout of the cover of the golf ball where the elongated grooves are of maximum length, as substantially equal to three times the mean center to center distance between adjacent dimples plus one mean diameter of a dimple.

FIG. 4 shows another modification of the present invention wherein elongated grooves 30 are of maximum length, which is defined as being substantially equal to three times the mean center to center distance between adjacent dimples plus one mean diameter of a dimple. Three times the mean center to center distance between adjacent dimples is labeled as "a", and the length of the maximum groove 30 is labeled as "b". Hence, $b=a+y$.

It should be understood by those skilled in this art that while the elongated grooves 26 and 30 have been illustrated in a uniform side-by-side relationship, they could be arranged offset from each adjacent groove, in a zig-zag fashion, without departing from the scope of the present invention.

Figure 5:
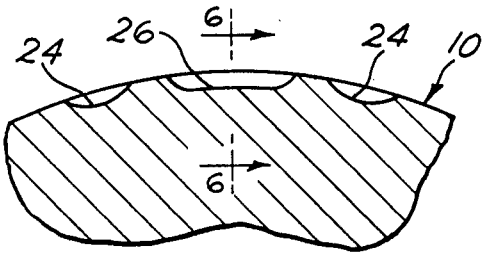
FIG. 5 is a fragmentary view in cross section of the golf ball of FIG. 2 taken on the line 5—5 of FIG. 2 to show that the elongated groove has substantially the same depth as the depth of a dimple, and that the bottom surface of the groove is generally concentric with the circumference of the ball, and that the opposite ends of each groove are reduced to prevent the accumulation of dirt therein.

FIG. 5 is a fragmentary view of the ball 10 in cross section taken on line 5—5 of FIG. 2 showing the dimples 24 and an elongated groove 26. Notice that the groove 26 has substantially the same depth as the depth of a dimple 24. Also, notice that the bottom surface of the groove 26 is generally concentric with the circumference of the ball, and that the opposite ends of the groove are reduced to prevent the accumulation of dirt therein.

Figure 6:
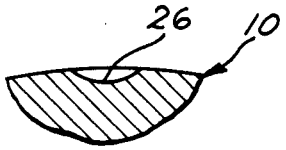
FIG. 6 is also a fragmentary view in cross section of the golf ball taken on the line 6—6 of FIG. 5 to show that the groove has a transverse width dimension substantially the same as the width of a dimple, and that the grooves have a generally uniform transverse cross section that is substantially the same as the transverse cross section of a dimple.

FIG. 6 is a fragmentary view of the ball in cross section taken on the line 6—6 of FIG. 5 to show that the groove 26 has a transverse width dimension that is substantially the same as the width of a dimple, and that the groove 26 has a generally uniform transverse cross section that is substantially the same as the transverse cross section of a dimple 24.

As is seen in both FIGS. 3 and 4 the two series of grooves 26 and 30 are generally parallel to each other. The minimum distance between the longitudinal axes of adjacent grooves 26, 26 and grooves 30, 30 is substantially equal to the mean center to center distance between adjacent rows of dimples, and the maximum distance between the longitudinal axes of adjacent grooves is substantially equal to three times the mean center to center distance between adjacent rows of dimples.

Figure 7:
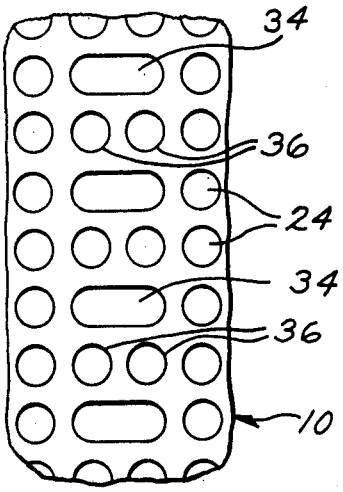
FIG. 7 is another modification of the present invention showing a layout view similar to FIG. 3 except that dimples are shown spaced between at least some of the adjacent grooves.

Now turning to the modification of FIG. 7, elongated grooves 34 are shown separated by dimples 36 as a possible variation of the invention of the other modifications.

Figure 8:
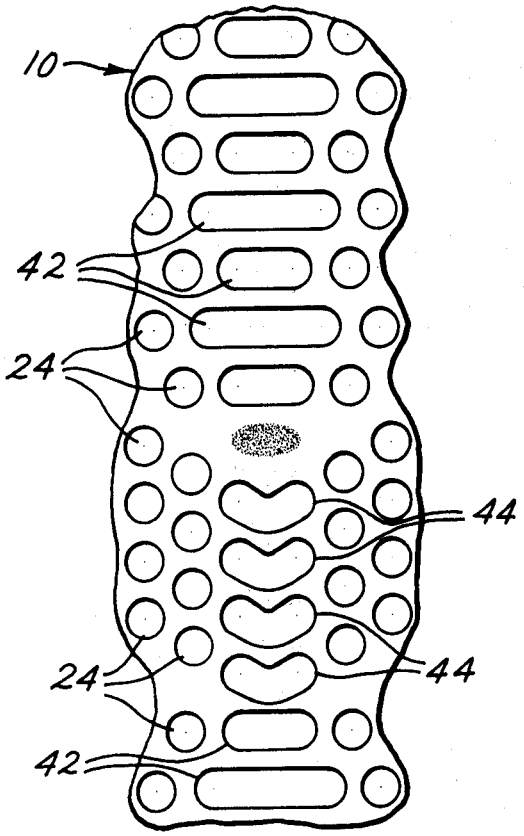
FIG. 8 is another modification of the present invention showing a fragmentary layout view of the cover with certain of the grooves being rectilinear and others being non-linear or chevron-like or of boomerang shape, and certain of the grooves may be longer than other grooves.

FIG. 8 is another modification of the present invention showing a fragmentary layout view of the ball 10 with a series of elongated grooves. Certain of these grooves are rectilinear grooves 42, while other grooves are non-linear or chevron-like grooves 44. Notice that adjacent grooves may be of variable lengths.

Figure 9:
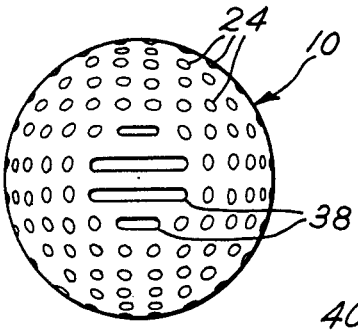
FIG. 9 is another modification of the golf ball of the present invention illustrated in an elevational view to show a cluster of about four elongated grooves that are centered on a great circle of the ball.

FIG. 9 shows another modification of the present invention with a cluster of elongated grooves 38 that are centered on a great circle of the ball 10. Now looking at FIG. 10, which is a top plan view of the golf ball of FIG. 9, it shows the brand name indicia 40 located at the very top of the ball for use in the accurate placement of the ball of FIG. 9 on the tee. The approximate center of the cluster of elongated grooves 38 is spaced about 90° from the center of the inidica 40.

Figure 10:
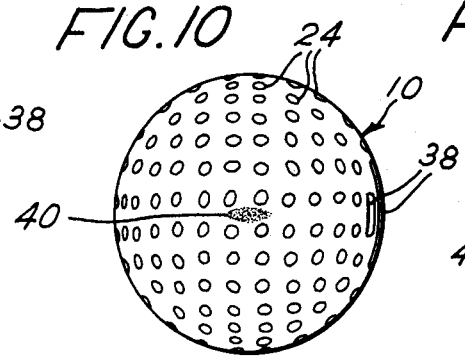
FIG. 10 is a top plan view of the golf ball of FIG. 9 and it shows the brand name indicia located at the very top of the ball for use in the placement of the ball of FIG. 9 on the tee.
Figure 11:
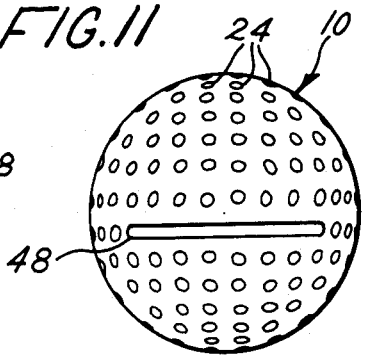
FIG. 11 is another modification of the golf ball of the present invention illustrated in an elevational view to show a single elongated groove that is centered on a great circle of the ball but does not circumscribe the entire circumference of the ball.

FIG. 11 shows another modification of the present invention with a single elongated groove 48 that is centered on a great circle of the ball, but does not circumscribe the entire circumference of the ball. The center of this elongated groove 48 would be spaced about 90° from the center of the brand name indicia 40 that is at the north pole or very top of the ball, as is shown in FIG. 10.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A golf ball in the shape of a sphere having in its outer surface a plurality of spaced dimples which substantially cover the outer surface, the invention comprising:

a. at least one elongated groove on the outer surface of the ball which encompasses at least two of the said dimples for use in interlocking with the striking face of a golf club;

b. the groove having a transverse width dimension substantially the same as the width of a dimple;

c. the groove having a generally uniform transverse cross section substantially the same as the transverse cross section of a dimple;

d. the groove having reduced ends.

2. The invention as recited in claim 1, wherein there are a plurality of grooves that are generally parallel to each other, and the minimum distance between the longitudinal axes of adjacent grooves is substantially equal to the mean center to center distance between adjacent rows of dimples, and the maximum distance between the longitudinal axes of adjacent grooves is substantially equal to three times the mean center to center distance between adjacent rows of dimples.

3. The invention as recited in claim 1 wherein an indicia is marked on the outer surface of the ball, the center of said indicia being substantially spaced about 90° from the center of the groove.

4. The invention as recited in claim 1 wherein there are a plurality of grooves that are generally parallel to each other, and the minimum length of the grooves is defined as being substantially equal to the mean center to center distance between adjacent dimples plus one mean diameter of a dimple, while the maximum length of the grooves is defined as being substantially equal to three times the mean center to center distance between adjacent dimples plus one mean diameter of a dimple.

5. The invention as recited in claim 4 wherein the grooves form a continuous band around the circumference of the ball.

6. The invention as recited in claims 2 or 4 wherein the grooves extend in a comtinuous band around the circumference of the ball, there being a mixture of both minimum and maximum length grooves.

7. The invention as recited in claim 4 wherein the grooves are each substantially positioned within a continuous row of dimples.

8. The invention as recited in claims 2 or 4 wherein the grooves form a continuous band around the circumference of the ball, and dimples are spaced between at least some of the adjacent grooves.

9. The invention as recited in claims 2 or 4 wherein a cluster of about four grooves are centered on a great circle of the ball, and an indicia is marked on the outer surface of the ball, the center of said indicia being substantially spaced about 90° from the center of the cluster of grooves.

10. The invention as recited in claims 2 or 4 wherein a cluster of about four grooves are centered on a great circle of the ball, and an indicia is marked on the outer surface of the ball, the center of said indicia being substantially spaced about 90° from the center of the cluster of grooves, there being two clusters of grooves located on generally diametrically opposite sides of the ball to form a configuration of symmetry.

11. The invention as recited in claims 2 or 4 wherein the grooves form a continuous band around the circumference of the ball, and where certain grooves are of generally straight lengths while the remainder of the grooves have a chevron-like shape.

12. A golf ball in the shape of a sphere having in its outer surface a plurality of spaced dimples which substantially cover the outer surface, the invention comprising:

a. at least one elongated groove arranged within a continuous row of dimples and encompassing at least two of said dimples;

b. the groove having a transverse width dimension substantially the same as the width of a dimple;

c. the groove having a generally uniform transverse cross section that is substantially the same as the transverse cross section of a dimple;

d. the groove having rounded ends;

e. the bottom surface of the groove being generally concentric with the circumference of the ball;

f. the groove having a length that is less than the circumference of the ball.

13. The invention as recited in claims 1 or 11 wherein there are a plurality of grooves that form a continuous band around the circumference of the ball, certain of the grooves being rectilinear and generally parallel to each other, while other grooves are non-linear while being generally parallel to each other.

14. The invention as recited in claims 1 or 11 wherein there are a plurality of grooves that form a band around the circumference of the ball, certain of the grooves being offset from adjacent grooves.

* * * * *